US008618938B2

(12) United States Patent
Masin

(10) Patent No.: US 8,618,938 B2
(45) Date of Patent: Dec. 31, 2013

(54) GAS CYLINDER AND RFID TRANSPONDER ASSEMBLIES AND RELATED METHODS HAVING FIXED TRANSPONDER ORIENTATIONS

(75) Inventor: Joseph V. Masin, Santa Barbara, CA (US)

(73) Assignee: Trovan, Ltd. (GB)

( * ) Notice: Subject to any disclaimer, the term of this patent is extended or adjusted under 35 U.S.C. 154(b) by 233 days.

(21) Appl. No.: 13/300,835

(22) Filed: Nov. 21, 2011

(65) Prior Publication Data

US 2013/0126364 A1 May 23, 2013

(51) Int. Cl.
*G08B 13/14* (2006.01)

(52) U.S. Cl.
USPC ..... 340/572.8

(58) Field of Classification Search
USPC ..... 235/435
See application file for complete search history.

(56) References Cited

U.S. PATENT DOCUMENTS

| | | | | |
|---|---|---|---|---|
| 4,746,556 | A | 5/1988 | Matsuguchi et al. | 428/40 |
| 5,523,750 | A * | 6/1996 | de Vall | 340/870.31 |
| 5,867,102 | A | 2/1999 | Souder et al. | 340/572 |
| 6,043,746 | A | 3/2000 | Sorrells | 340/572.7 |
| 6,121,880 | A | 9/2000 | Scott et al. | 340/572.5 |
| 6,262,692 | B1 | 7/2001 | Babb | 343/895 |
| 6,421,013 | B1 | 7/2002 | Chung | 343/700 |
| 6,888,509 | B2 | 5/2005 | Atherton | 343/718 |
| 7,049,962 | B2 | 5/2006 | Atherton et al. | 340/572.1 |
| 7,095,324 | B2 | 8/2006 | Conwell et al. | 340/572.1 |
| 7,855,649 | B2 | 12/2010 | Masin | 340/572.8 |
| 2001/0041551 | A1 | 11/2001 | Rotzoll | |
| 2006/0202824 | A1 | 9/2006 | Carroll et al. | 340/568.1 |
| 2007/0029384 | A1 | 2/2007 | Atherton | 235/435 |
| 2007/0247317 | A1 | 10/2007 | Farrell | 340/572.8 |
| 2008/0016005 | A1 | 1/2008 | Owen et al. | 705/73 |
| 2008/0084306 | A1* | 4/2008 | Durtschi et al. | 340/572.1 |
| 2008/0110774 | A1 | 5/2008 | Chisholm et al. | |
| 2008/0186367 | A1 | 8/2008 | Adkins et al. | |
| 2009/0045963 | A1 | 2/2009 | Vigneron et al. | 340/572.8 |
| 2009/0121877 | A1 | 5/2009 | Henderson | 340/572.7 |
| 2009/0128340 | A1* | 5/2009 | Masin | 340/572.9 |
| 2011/0140850 | A1* | 6/2011 | Wassel et al. | 340/8.1 |
| 2012/0187197 | A1* | 7/2012 | Masin | 235/492 |

OTHER PUBLICATIONS

U.S. Appl. No. 13/010,243, "*Embedded RFID Tags and Associated Methods and Systems*," filed Jan. 20, 2011.

* cited by examiner

*Primary Examiner* — Brian Zimmerman
*Assistant Examiner* — Thomas McCormack
(74) *Attorney, Agent, or Firm* — Egan, Peterman & Enders LLP

(57) ABSTRACT

Gas cylinder and RFID (radio frequency identification) transponder assemblies and related methods are disclosed that utilize fixed orientations for RFID transponders to overcome problems existing with previous solutions. The disclosed embodiments provide an advantageous solution for utilizing metal plates, such as metal identification plates, to house RFID transponders and to fix the orientation of the RFID transponders to overcame the adverse effects of metal structures distorting the magnetic fields associated with gas cylinders. This fixed orientation combined with a transponder embodying a copper wire antenna wound around a longitudinal axis of a ferrite core and the use of PSK (phase shift keying) modulation allows for adequate reader performance despite the presence of interfering metal structures such as a metal plate used to house an RFID transponder.

22 Claims, 6 Drawing Sheets

GAS CYLINDER AND RFID TRANSPONDER ASSEMBLIES AND RELATED METHODS HAVING FIXED TRANSPONDER ORIENTATIONS

TECHNICAL FIELD OF THE INVENTION

The present invention relates generally to miniature electronic devices and more particularly to miniature transponder devices suitable for assets management and other purposes.

BACKGROUND

Prior RFID (radio frequency identification) tags exist that are used to help track various products. RFID tags are typically an assembly including an RFID transponder coupled into a protective housing, and the assembly can then be used for assets management, container safety inspection purposes, fraud prevention, ownership identification or other purposes. One application for such RFID tags, for example, is the use of RFID tags to help track hazardous products, such as liquid propane gas (LPG) stored in metal containers or cylinders.

FIG. 1A (Prior Art) is a diagram of an embodiment 100 including a container or cylinder 102. The container 102 can be, for example, a metal cylinder holding LPG (liquid propane gas) or other hazardous or non-hazardous material. The gas cylinder 102 includes a metal valve flange 108 welded into a central opening at the top of the cylinder 102. As described in more detail below, the metal valve flange 108 can be configured to provide a primary valve opening into which a valve can be inserted and coupled. For example, the opening can be threaded to allow a primary valve to be attached by screwing the valve into place. As also described further below, a second opening can also be provided in the metal valve flange into which a second valve can be inserted and coupled. For example, the second opening can also be threaded and provide a secondary access port into which an emergency pressure relief valve can screwed into place. Such a relief valve is a mandatory regulatory requirement in some geographic regions for certain containers, such as metal cylinders holding LPG in Brazil In addition, as depicted, one or more metal stay plates 106 can also be connected to the gas containing portion of the cylinder 102 and to a metal ring 110. The metal ring 110 can be used, for example, to protect valves coupled to a metal valve flange 108, and the metal ring 110 can be used for picking up or moving the cylinder 102.

FIG. 1B (Prior Art) is a diagram for a metal valve flange 108 for the metal cylinder 102 of FIG. 1A (Prior Art). The metal valve flange 108 includes a primary valve opening 114 and a secondary valve opening 112. The primary valve opening 114 is configured to receive a valve, such as a brass valve, which can be screwed into place. The secondary port opening 112 is also configured to receive a valve, such as a brass pressure relief valve, which can also be screwed into place.

Many gas containers or cylinders, such as those represented in FIGS. 1A-1B, are already in commercial use, and do not have RFID tags or RFID transponders for security and tracking purposes. Further, existing containers or cylinders are being re-used so that many non-tagged containers and cylinders are still being used and will likely continue to be used. As part of the re-use process, a metal identification plate is often used to label or re-label the container/cylinder after mandatory periodic requalification, overhaul and/or retesting of the cylinder has been performed.

FIG. 2A (Prior Art) is a diagram for a metal plate 200, such as a C-shaped metal plate, that can be used to provide labeling information for a cylinder 102 that has been re-qualified. The metal plate 200, for example, can include company information, tare weight of the container, data pertinent to the requalification process performed, date of next inspection and/or any other desired information required by the regulating agency.

FIG. 2B (Prior Art) is a diagram for a metal plate 200 that has been coupled to a valve flange 108, for example, by welding the metal plate 200 to the valve flange 108. As in FIG. 1B (Prior Art), the valve flange 108 can include a primary valve opening 114 and a secondary relief valve port 112, if desired.

As stated above, many gas containers or cylinders, such as those represented in FIGS. 1A-1B, are already in commercial use, and do not have RFID tags or RFID transponders for safety, security and tracking purposes. Determining an effective and secure method for including RFID transponders on these gas cylinders is a difficult problem facing many countries that rely heavily on gas cylinders for energy needs. Further, one problem associated with placing RFID transponders on prior art gas cylinders is that metal structures, such as metal stay plates and protective rings, interfere with RFID communications.

SUMMARY OF THE INVENTION

Gas cylinder and RFID (radio frequency identification) transponder assemblies and related methods are disclosed that utilize fixed orientations for RFID transponders to overcome problems existing with previous solutions. The disclosed embodiments provide an advantageous solution for utilizing metal plates, such as metal identification plates, to house RFID transponders and to fix the orientation of the RFID transponders to overcome the adverse effects of metal structures distorting the magnetic fields associated with gas cylinders. This fixed orientation combined with a transponder embodying a copper wire antenna wound around a longitudinal axis of a ferrite core and the use of PSK (phase shift keying) modulation allows for adequate reader performance despite the presence of interfering metal structures such as a metal plate used to house an RFID transponder. Other features and variations can be implemented, if desired, and related systems and methods can be utilized as well.

DESCRIPTION OF THE DRAWINGS

It is noted that the appended drawings illustrate only exemplary embodiments of the invention and are, therefore, not to be considered limiting of its scope, for the invention may admit to other equally effective embodiments.

DETAILED DESCRIPTION OF THE INVENTION

Assemblies and related systems and methods for fixed orientation of RFID (radio frequency identification) transponders with respect to gas cylinders are disclosed that overcome problems existing with previous solutions. In particular, the disclosed embodiments provide an advantageous solution for utilizing metal plates, such as metal identification plates, to house RFID transponders having elongated ferrite core antennas and to fix their orientation with respect to the gas cylinder. The disclosed embodiments and fixed orientation allow for adequate performance where it would be assumed that metal structures would render reader communication inoperable. Other features and variations can be implemented, if desired, and related systems and methods can be utilized as well.

The embodiments will now be described in more detail with respect to FIGS. 3A-C, FIG. 4, FIGS. 5A-5C and FIG. 6. According to the embodiments described herein, RFID transponders having an antenna wire wrapped around a ferrite core are oriented in particular ways to improve the overall performance of the system and to overcome interference caused by metal structures. Further, if desired, the RFID transponders can use PSK (phase shift keying) modulation to improve communication with readers where metal plates are used to house the RFID transponders or where other metal structures may interfere with communications between the RFID reader and transponder. It is further noted that the RFID transponders described herein are particularly useful for controlling and monitoring the distribution and use of hazardous materials in objects or containers, as well as the safety of the containers themselves.

Figure 1A:
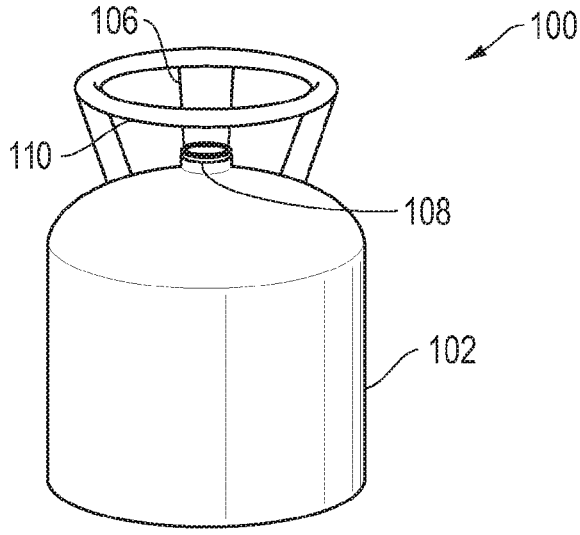
FIG. 1A (Prior Art)
FIG. 1A (Prior Art) is a diagram for a gas container having a metal valve flange, such as a metal cylinder holding liquid propane gas (LPG).
Figure 1B:
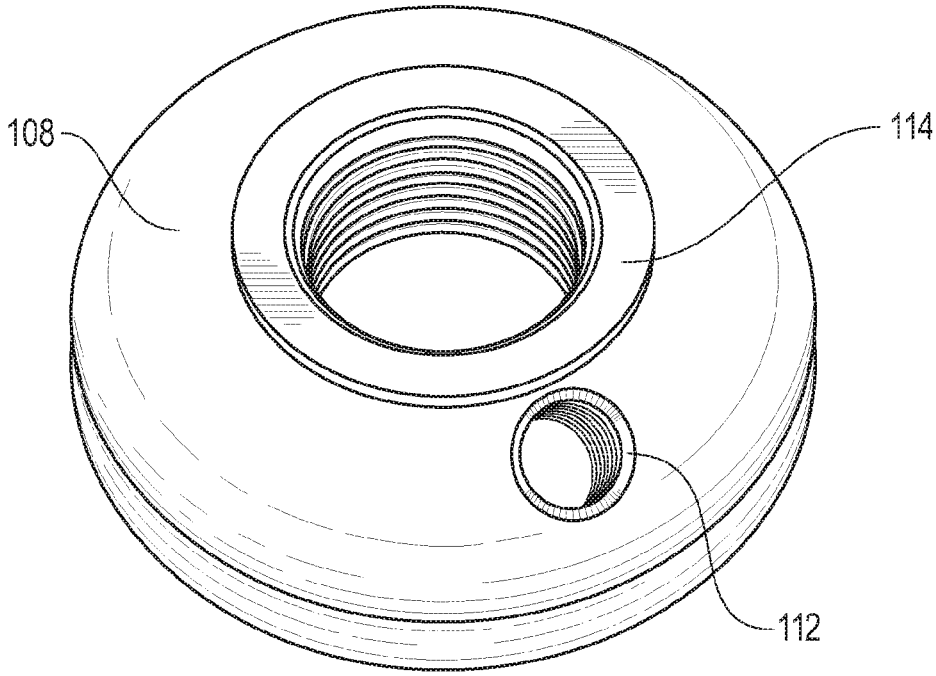
FIG. 1B (Prior Art)
FIG. 1B (Prior Art) is a diagram for a metal valve flange for the cylinder of FIG. 1A (Prior Art).
Figure 2A:
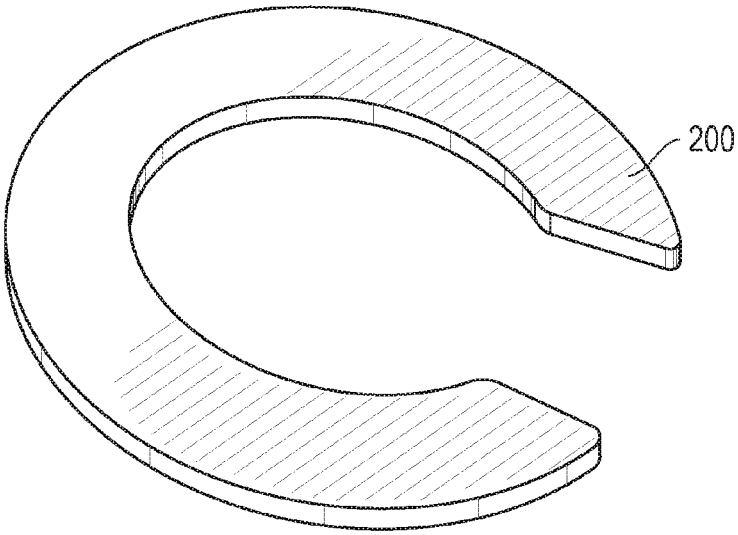
FIG. 2A (Prior Art)
FIG. 2A (Prior Art) is a diagram of a C-shaped metal plate that is used for identification and labeling of containers such as the container of FIG. 1A (Prior Art).
Figure 2B:
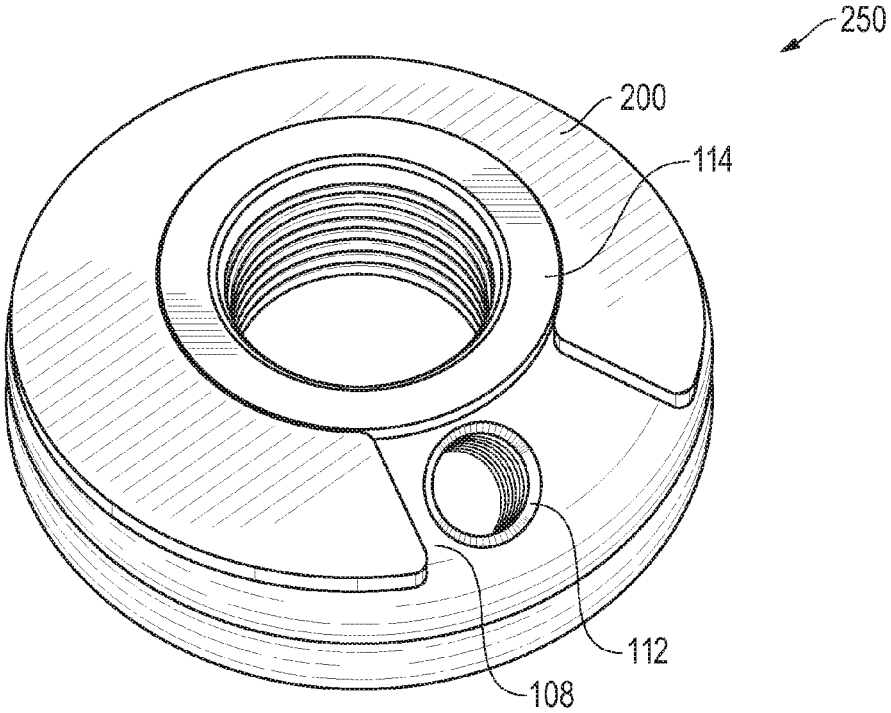
FIG. 2B (Prior Art)
FIG. 2B (Prior Art) is a diagram of the C-shaped metal plate of FIG. 2A (Prior Art) welded to the metal valve flange of FIG. 1B (Prior Art).
Figure 3A:
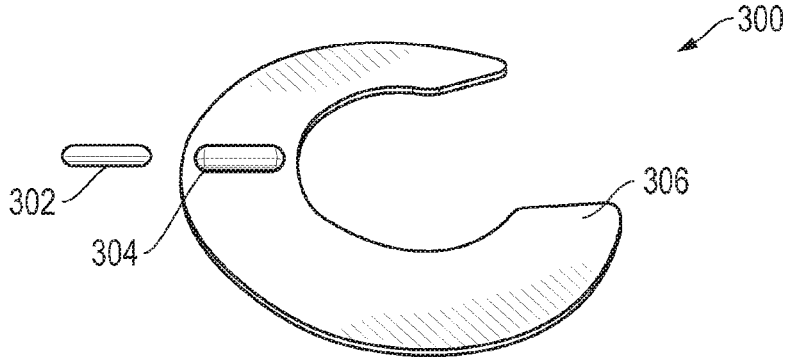
FIG. 3A is a top-view diagram of a C-shaped metal plate having a recess formed in its bottom surface for housing a transponder and fixing its orientation.

FIG. 3A is a top-view diagram 300 for a metal plate 306, such as a C-shaped metal plate, that has been configured to include a recess or indentation 304. Recess 304 is configured to provide space to house a transponder 302 once the metal plate 306 is coupled to a gas cylinder, such as on top of a valve flange. Further, the recess or indentation 304 is formed within the bottom surface of the metal plate 306 and is oriented so as fix the orientation of the RFID transponder with respect to the valve flange. This fixed orientation improves performance of the RFID transponder 302 with respect to an RFID reader, which will typically be placed over or near the valve flange for the gas cylinder. This desired orientation for the RFID transponder is described in further detail below with respect to FIG. 4 and FIG. 5A. It is noted that the metal plate 306 can be other shapes, as desired, and that the C-shape depicted is just one example shape. It is further noted that the bottom surface of the metal plate can be slightly conical in shape so as to fit along the curved top surface of a valve flange, which is typically curved to match the shape of a gas cylinder to which it is welded.

It is further noted that the transponder 302 has a ferrite core antenna made of copper wire (e.g., 5-15 microns thickness) that is wound around an elongated ferrite core and connected to an RFID integrated circuit. Further, the transponder 302 can be encapsulated in glass for additional protection against outside elements over a long time periods. Alternatively, the transponder 302 can be used without protective glass encapsulation. The transponder 302 is preferably a miniaturized transponder having a size of about 100 cubic millimeters (mm) or less and having dimensions of about 10-14 mm or less in length (L) and about 2-3 mm or less in diameter (D). Example miniaturized transponders are described, for example, in U.S. Pat. No. 5,281,855, U.S. Pat. No. 5,572,410, U.S. Pat. No. 5,084,699, U.S. Pat. No. 7,176,846, U.S. Pat. No. 7,825,869, and U.S. Pat. No. 7,855,649, each of which is hereby incorporated by reference in its entirety.

Figure 3B:
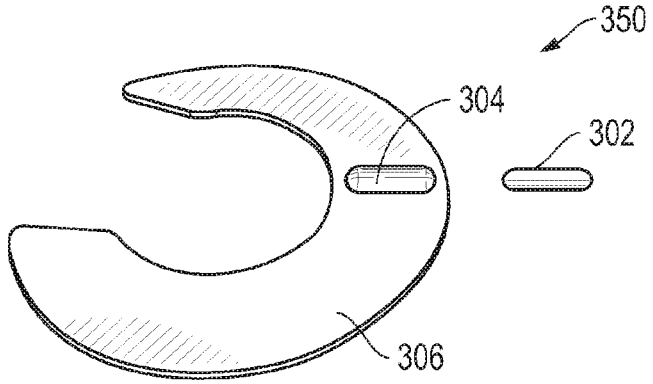
FIG. 3B is a bottom-view diagram for a C-shaped metal plate having a recess formed in its bottom surface for housing a transponder and fixing its orientation.

FIG. 3B is a bottom-view diagram 350 for the metal plate 306 that has been configured to include a recess or indentation 304. As stated above, the recess or indentation 304 is configured to fix the orientation of the RFID transponder 302 and to provide space to house the transponder 302 once the metal plate 306 is coupled to a container. Thus, the recess or indentation 304 is preferably slightly bigger than the transponder 302 so as to house the transponder 302 while still fixing its orientation.

Figure 3C:
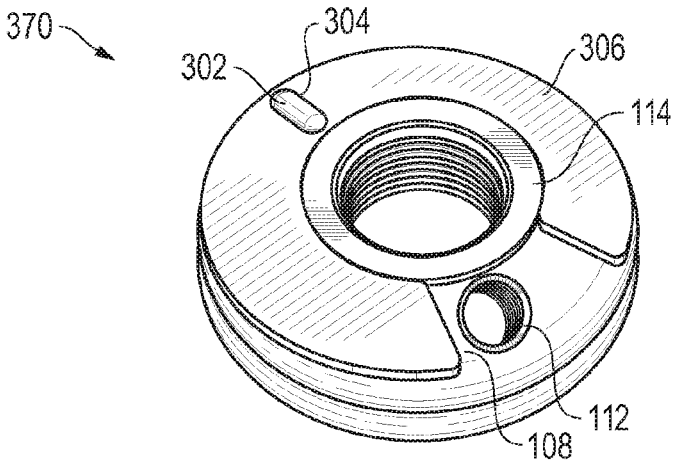
FIG. 3C is a top-view diagram for the C-shaped metal plate of FIGS. 3A-3B that has been affixed to the metal valve flange of a gas cylinder.

FIG. 3C is a top-view diagram 370 for a metal plate 306 that has been coupled to a valve flange 108, for example, by welding the metal plate 306 to the valve flange 108. The transponder 302 (not seen) is positioned underneath the metal plate 306 within the recess or indentation 304. As described above, the valve flange can include a primary valve opening 114 and a secondary relief valve port 112, if desired. It is noted that techniques other than welding could also be used to fix the metal plate 306 to the valve flange 108. For example, a glue or an epoxy material could be used to couple the metal plate 306 to the valve flange 108.

Figure 4:
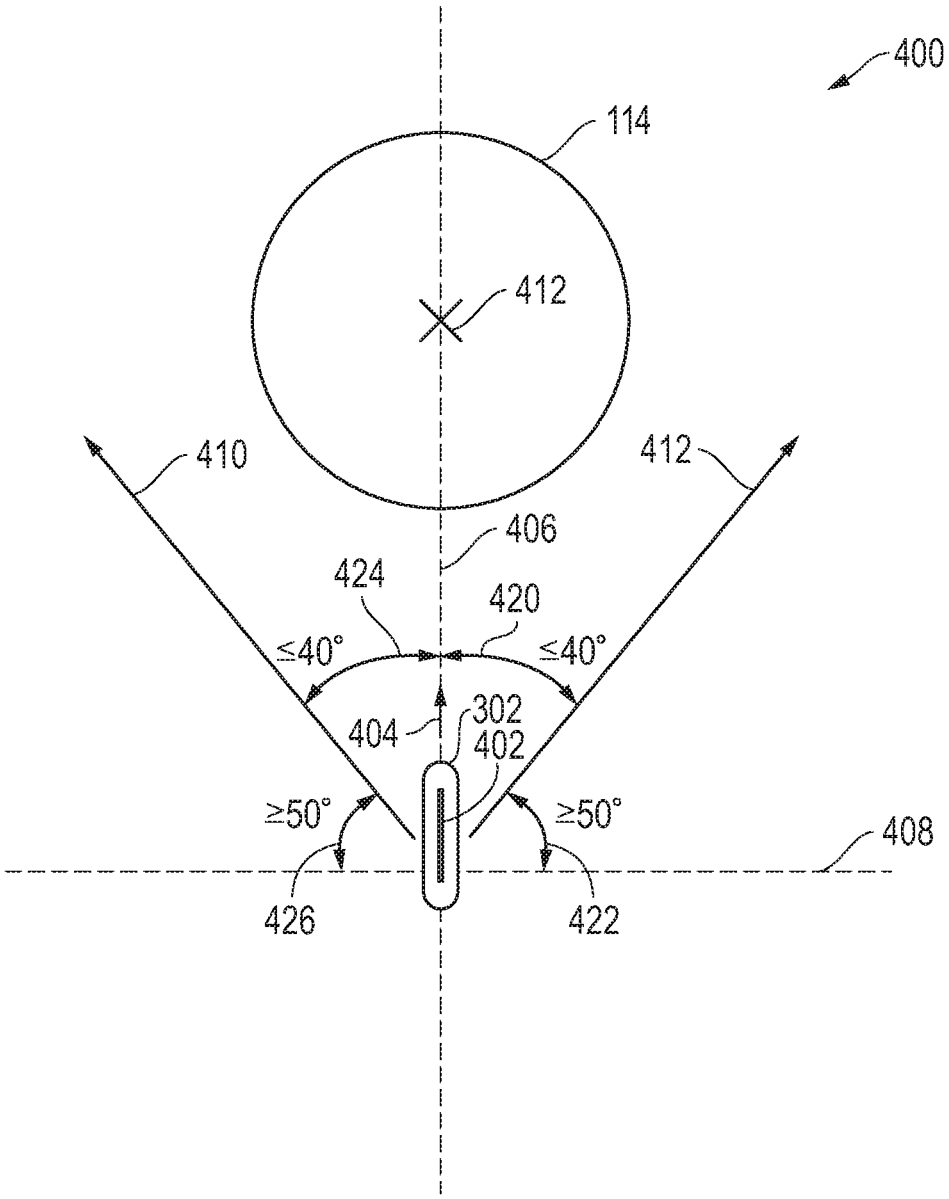
FIG. 4 is a diagram for the fixed orientation of the transponder with respect to the center axis for the primary opening in the metal valve flange.

FIG. 4 provides a diagram 400 for the fixed orientation of the transponder 302 with respect to the primary valve opening 114 of the valve flange 108. The "X" marks the center axis 412 of this valve flange 108 and its primary valve opening 114. While the metal plate 306 that covers the transponder 302 would be expected to interfere with the transponder 302 so that detection using a RFID reader would be very difficult if not impossible, it has been found that orienting the transponder as shown in FIG. 4 allows for acceptable reader performance despite the metal plate 306 covering the transponder 302. In particular, as depicted, the transponder 302 has a ferrite core antenna 402 that is elongated in shape, and the direction of this elongation, as represented by arrow 404, is oriented with respect to the center axis 412 of the primary valve opening 412 such that the angle of deviation is less then or equal to 40 degrees. In other words, the elongated ferrite core antenna 402 within the recess 304 has a fixed orientation such that a line passing through a center of the elongated ferrite core antenna 402, as represented by arrow 404, is less than or equal to 40 degrees offset from a line 406 passing through a center axis 412 of the valve flange and the RFID transponder 402. When this orientation is maintained by the recess or indentation 304 for the metal plate 306, reception of the communications by the transponder 302 to a reader are adequate, even though the plate 306 is metal and would be expected to interfere too much with the transponder 302 for operable communications.

Looking in more detail to FIG. 4, the desired fixed orientation of the transponder 302 will be further explained. The dotted line 406 represents a line extending through the transponder 302 and the center axis 412 of the primary opening 414 in the plane of the valve flange 108. The dotted line 408 represents a line perpendicular to the dotted line 406. The arrow 404 represents a line passing through the elongated ferrite core antenna 402 when the transponder 302 is fixed in place by the metal plate 306. The arrow 404 can also be considered to represent the elongated direction of the recess or indentation 304 that houses the transponder 302, as it will determine the orientation of the transponder 302 once the assembly is completed. The lines 410 and 412 represent potential deviations or offsets in the direction to which the arrow 404 points (i.e., direction of elongated core) from the line 406. It is desired that the deviations 420 and 424 from the line 406 be equal to or less than 40 degrees, and preferably be equal to or less than 15%. As such, it is desirable for the angles represented by 422 and 426 to be equal to or greater than 50 degrees, and preferably be equal to or greater than 75%. This fixed orientation of the ferrite core 402 with respect to the center axis 412 of the main valve opening 114 allows for adequate reception by an RFID reader of communications from the RFID transponder 302, where one would expect signals to have been blocked by the metal plate 306.

This communications between the RFID transponder 302 and an RFID reader is further improved by the use of PSK modulation by the RFID transponder. For example, the metal plate 304 can interfere with the RFID communications. Further, when a metal ring, such as ring 110, is used to protect valves with respect to a gas cylinder 102, the metal ring 110 can also interfere with RF signals being communicated to and from an RFID transponder 302. It is found that it is preferable to utilize PSK (phase shift keying) modulation for the RF signals being used to communicate information to and/or from the RFID transponder 302. For example, when PSK modulation is used by the RFID transponder 302, increased communication range is achieved with respect to a reader that is reading information from the RFID transponder 302, as compared to implementations where FSK (frequency shift keying) modulation or ASK (amplitude shift keying) modulation is being used. As such, using PSK modulation with respect to the RFID transponder 302 is preferable in these embodiments where a metal plate 304 is used to house the RFID transponder 302 and to fix its orientation with respect to the gas cylinder 102. Still further, it is noted that the RFID transponder 302 can be configured to use frequencies equal to or less than 200 kHz in communicating with an external reader to further improve performance.

Figure 5A:
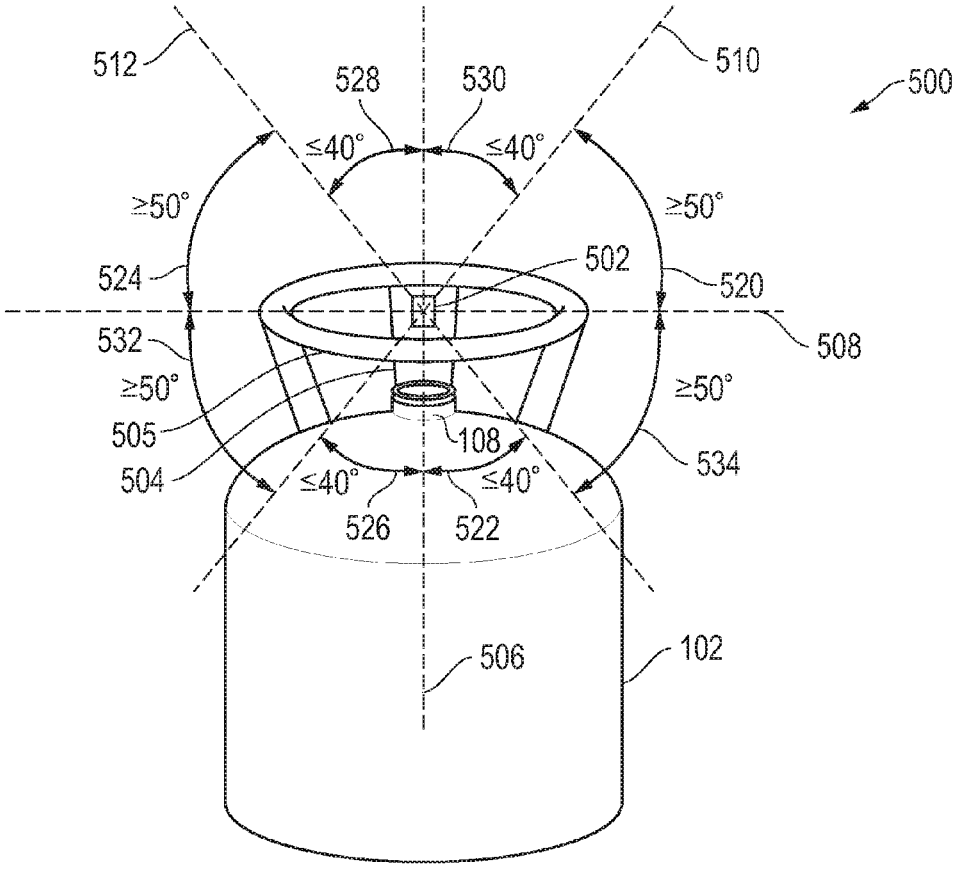
FIG. 5A is a diagram for an alternative embodiment using a metal plate that is fixed, for example, to a protective metal stay plate for the gas cylinder.

FIG. 5A is a diagram for an alternative embodiment 500 where a transponder under a protective metal plate 502 is coupled in a different manner to the gas cylinder 102, such as to a stay plate 504 that is coupled to the gas cylinder 102 and to a protective ring 505. For this alternative embodiment 500, the RFID transponder is still oriented within a particular offset range with respect to the center axis of the valve flange 108. As depicted, this center axis is represented by dotted line 506. Dotted line 508 represents a line that is perpendicular to the dotted line 506. As described above, the transponder included under the protective plate 502 includes an elongated ferrite core antenna, such as thee elongated ferrite core antenna 402 in FIG. 4. This elongated ferrite core antenna is aligned with the center axis 506 or offset from this line within a particular range to provide for adequate reader performance. In particular, similar to FIG. 4, the deviation or offset lines 510 and 512 are equal to or less than 40 degrees from the center axis 506, as represented by arrows 522, 526, 528 and 530. In such an embodiment, the angles represented by 520, 524, 532 and 534 are equal to or greater than 50 degrees. Preferably, the angles of deviation or offset represented by arrows 522, 526, 528 and 530 are equal to or less than 15 degrees to provide improved reader performance. In such a further embodiment, the angles represented by 520, 524, 532 and 534 are equal to or greater than 75 degrees. It is noted that this fixed orientation is determined such that a line passing through a center of the elongated ferrite core antenna (e.g., line 510 or 512 when offset or deviated from line 506) is less than or equal to 40 degrees offset from a line 506 passing vertically through a center axis of the central opening of the gas cylinder they are considered to be in the same plane.

Figure 5B:
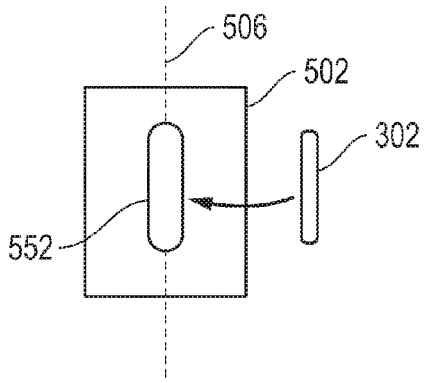
FIG. 5B is a bottom-view diagram for a metal plate having a recess formed in its bottom surface for housing a transponder and fixing its orientation.

FIG. 5B is a bottom-view diagram for a metal plate 502 having a recess or indentation 552 formed in its bottom surface for housing a transponder 302. When the metal plate 502 is affixed to a portion of the container, such as the stay plate 504, the orientation of the transponder 302 is then fixed with respect to the center axis 506 of the primary valve opening. The metal plate 502 can be coupled to the stay plate 504, for example, by welding the metal plate 502 to the stay plate 504. Other techniques could also be used to fix the metal plate 502 to the stay plate 504, such a glue or an epoxy. As depicted, the metal plate 502 is a four-sided metal plate. However, as described above, other shapes could also be used, if desired, and the metal plate can be configured to have a bottom surface that conforms or matches the shape of the surface to which the metal plate is being attached.

Figure 5C:
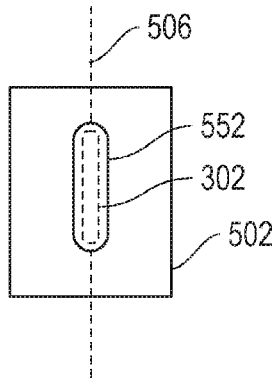
FIG. 5C is a top-view diagram for a metal plate having a recess formed in its bottom surface for housing a transponder and fixing its orientation.

FIG. 5C is a top-view diagram for the metal plate 502 having a recess or indentation 552 formed in its bottom surface for housing the transponder 302 and for fixing its orientation. As indicated with the dotted lines, transponder 302 sits under the metal plate 502 and within the recess or indentation 552.

It is noted that other metal protection mechanisms welded or otherwise affixed to the gas cylinder 102 can be used to provide for valve assembly protection and a carrying facility. For example, the metal protection mechanism can be a metal carrying handle welded to the gas cylinder 102. The metal protection mechanism can also be a metal ring and one or more metal stay plates welded together and to the gas cylinder 102, as shown in FIG. 5A. The metal plate 502, which houses the transponder 302, can be welded or other affixed to these metal protection mechanisms or other structures, as desired, depending upon how the gas cylinder is implemented.

Figure 6A:
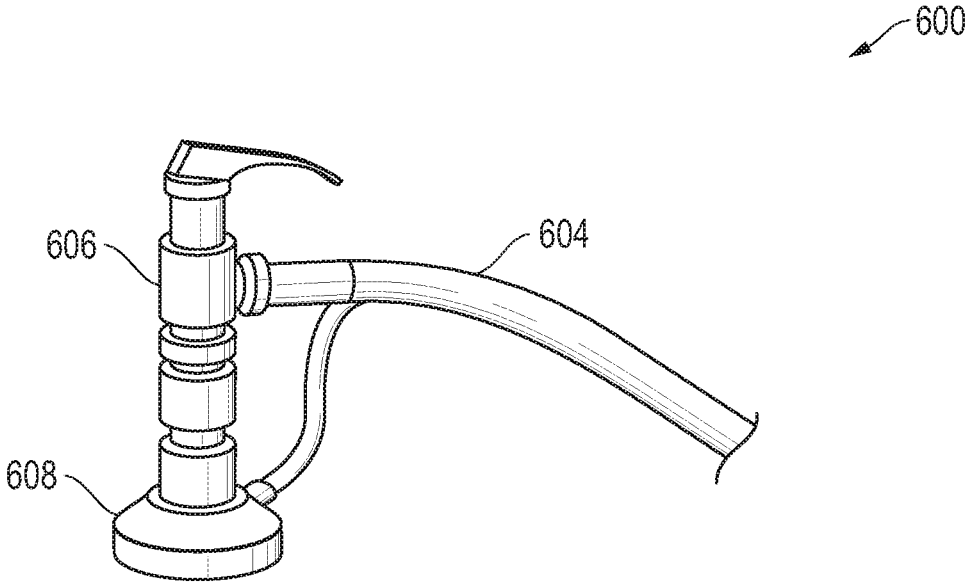
FIG. 6A is a diagram for a nozzle reader assembly that can be used to read the transponders described herein.

FIG. 6A is a diagram for a nozzle reader assembly 600. The nozzle reader assembly 600 includes an antenna portion 608, a nozzle connector portion 606, and a hose 604. The nozzle reader assembly 600 can be used to read the transponder 302 on the cylinder 102 during refueling.

Figure 6B:
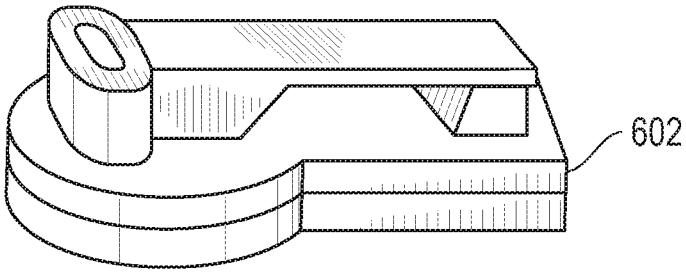
FIG. 6B is a diagram for a hand held reader that can be used to read the transponders described herein.

FIG. 6B is a diagram for a hand held reader 602. The hand held reader 602 can be positioned over the valve flange 108 and can then be used to read the transponder 302 on the container or cylinder 102.

It is noted that other reader configurations could also be used, if desired. For example, a horizontal panel reader could be used to read the transponder 302 on the gas cylinder 102. In operation, the horizontal panel reader could be placed above the valve assembly, as well as above any protective carrying ring coupled to the gas cylinder. Further, a conveyor belt can be used to move a plurality of gas cylinders under the horizontal panel reader to allow for more efficient reading of transponders on a large number of gas cylinders.

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed is:

1. An assembly for fixed orientation of an RFID (radio frequency identification) transponder with respect to a gas cylinder, comprising:

a gas cylinder configured to store a gas, the gas cylinder having a central opening on its top surface;

a valve flange coupled within the central opening of the gas cylinder, the valve flange having a primary valve opening;

a metal plate having a bottom surface coupled to the gas cylinder, the metal plate having a recess formed within the bottom surface and configured to house an RFID transponder and to fix an orientation of the RFID transponder with respect to the primary valve opening; and an RFID transponder located within the recess of the metal plate, the RFID transponder having an elongated ferrite core antenna including a wire wrapped around a ferrite core and further having a volume of about 100 cubic millimeters or less;

wherein the RFID transponder is configured to communicate with an external reader using phase shift keying (PSK) modulation; and wherein the elongated ferrite core antenna of the RFID transponder within the recess has a fixed orientation such that a line passing through a center of the elongated ferrite core antenna is offset by 40 degrees or less from a line passing through a center axis of the valve flange and the RFID transponder.

2. The assembly of claim 1, wherein the line passing through the center of the elongated ferrite core antenna is offset by 15 degrees or less from the line passing through the center axis of the valve flange and the RFID transponder.

3. The assembly of claim 2, wherein the line passing through the center of the elongated ferrite core antenna also passes through the center axis of the valve flange.

4. The assembly of claim 1, wherein the bottom surface of the metal plate is coupled at least in part to a top surface of the valve flange.

5. The assembly of claim 4, wherein the valve flange has a curved top surface and wherein the bottom surface of the metal plate is slightly conical in shape so as to fit along the curved top surface of the valve flange.

6. The assembly of claim 4, wherein the metal container is configured to store liquid propane gas.

7. The assembly of claim 6, wherein the RFID transponder is configured to use a frequency below about 200 kHz for transmit and receive operations.

8. The assembly of claim 4, wherein the metal plate comprises a C-shaped metal plate such that the metal plate curves around the primary valve opening for the valve flange.

9. The assembly of claim 4, wherein the metal plate is welded to the valve flange.

10. The assembly of claim 4, wherein the metal plate is glued to the valve flange.

11. An assembly for fixed orientation of an RFID (radio frequency identification) transponder with respect to a gas cylinder, comprising:

a gas cylinder configured to store a gas, the gas cylinder having a central opening on its top surface and having a valve assembly coupled within the central opening;

a metal protection mechanism coupled to the gas cylinder to provide for valve assembly protection and a carrying facility;

a metal plate having a bottom surface coupled to the metal protection mechanism, the metal plate having a recess formed within the bottom surface and configured to house an RFID transponder and to fix an orientation of the RFID transponder with respect to the valve assembly; and an RFID transponder located within the recess of the metal plate, the RFID transponder having an elongated ferrite core antenna including a wire wrapped around a ferrite core and further having a volume of about 100 cubic millimeters or less;

wherein the RFID transponder is configured to communicate with an external reader using phase shift keying (PSK) modulation; and wherein the elongated ferrite core antenna of the RFID transponder within the recess has a fixed orientation such that a line passing through a center of the elongated ferrite core antenna is offset by 40 degrees or less from a line passing vertically through a center axis of the central opening of the gas cylinder when these lines are considered to be in a same plane.

12. The assembly of claim 11, wherein the metal protection mechanism comprises a metal carrying handle.

13. The assembly of claim 11, wherein the metal protection mechanism comprises a metal ring coupled to one or more metal stay plates, the one or more metal stay plates being coupled to that gas cylinder.

14. The assembly of claim 11, wherein the metal plate comprises a four-sided metal plate.

15. An method for fixing an orientation of an RFID (radio frequency identification) transponder with respect to a gas cylinder, comprising:

providing a gas cylinder configured to store a gas, the gas cylinder having a central opening on its top surface and having a valve flange coupled within the central opening, the valve flange having a primary valve opening;

providing a metal plate having a recess formed within a bottom surface, the recess being configured to house an RFID transponder and to fix an orientation of the RFID transponder;

inserting an RFID transponder within the recess of the metal plate, the RFID transponder having an elongated ferrite core antenna including a wire wrapped around a ferrite core and further having a volume of about 100 cubic millimeters or less; and coupling the bottom surface of the metal plate to the gas cylinder so as to house the RFID transponder and to fix an orientation of the RFID transponder;

wherein the RFID transponder is configured to communicate with an external reader using phase shift keying (PSK) modulation; and wherein the elongated ferrite core antenna of the RFID transponder within the recess has a fixed orientation such that a line passing through a center of the elongated ferrite core antenna is offset by 40 degrees or less from a line passing through a center axis of the valve flange and the RFID transponder.

16. The method of claim 15, wherein the line passing through the center of the elongated ferrite core antenna is less than or equal to 15 degrees offset from the line passing through the center axis of the valve flange and the RFID transponder.

17. The method of claim 16, wherein the line passing through the center of the elongated ferrite core antenna also passes through the center axis of the valve flange.

18. The method of claim 15, wherein the coupling step comprises coupling the bottom surface of the metal plate at least in part to a top surface of the valve flange.

19. The method of claim 18, wherein the metal container is configured to store liquid propane gas.

20. The method of claim 19, wherein the RFID transponder is configured to use a frequency below about 200 kHz for transmit and receive operations.

21. The method of claim 18, wherein the coupling step comprises welding the metal plate to the valve flange.

22. The method of claim 18, wherein the coupling step comprises gluing metal plate to the valve flange.

* * * * *